United States Patent [19]

Toelke et al.

[11] 4,011,617

[45] Mar. 15, 1977

[54] CLEANER FOR TUBULAR PIN AND BOX ENDS

[76] Inventors: Lester W. Toelke, 12958A Trail Hollow, Houston, Tex. 77024; Malvern M. Hasha, 1527 Castlerock, Houston, Tex. 77090; Thomas W. Scott, 116 Maplewood Drive, Lafayette, La. 70501; Jack W. Hayden, 5215 Stamper Way, Houston, Tex. 77027

[22] Filed: July 7, 1975

[21] Appl. No.: 593,525

[52] U.S. Cl. ..... 15/88; 15/104.04

[51] Int. Cl.[2] ..... B08B 9/02

[58] Field of Search ..... 15/104.03, 104.04, 104.05, 15/21 R, 21 C, 21 D, 56, 75, 88, 97 R, 104.09, 36

[56] References Cited

UNITED STATES PATENTS 3,475,780 11/1969 Hettich et al. ..... 15/36

FOREIGN PATENTS OR APPLICATIONS 831,797 1/1970 Canada ..... 15/104.03

*Primary Examiner*—Edward L. Roberts
*Attorney, Agent, or Firm*—Vinson, Elkins, Searls, Connally & Smith

[57] ABSTRACT

An open ended housing means is provided for receiving the pin or male end of a tubular member in one open housing end and the box or female end of a tubular member in the other open housing end. Brush means are rotatably mounted in the housing means and positioned relative to the opening housing ends for engaging the tubular member end and means are provided for rotating the brush means to clean the engaged ends of the tubular member. Additional means control the flow of solvent and gas to the housing means to further aid in cleaning the ends of the tubular member.

18 Claims, 11 Drawing Figures fig.8
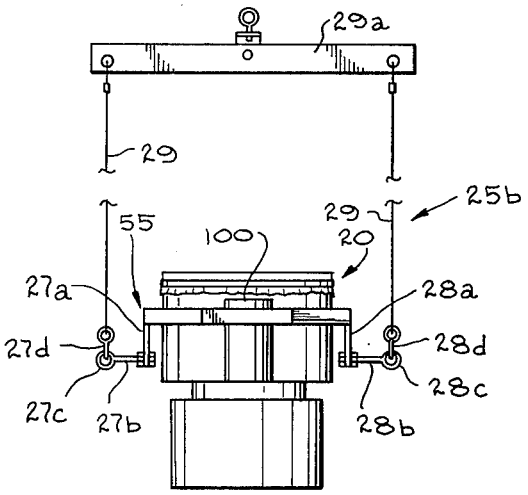
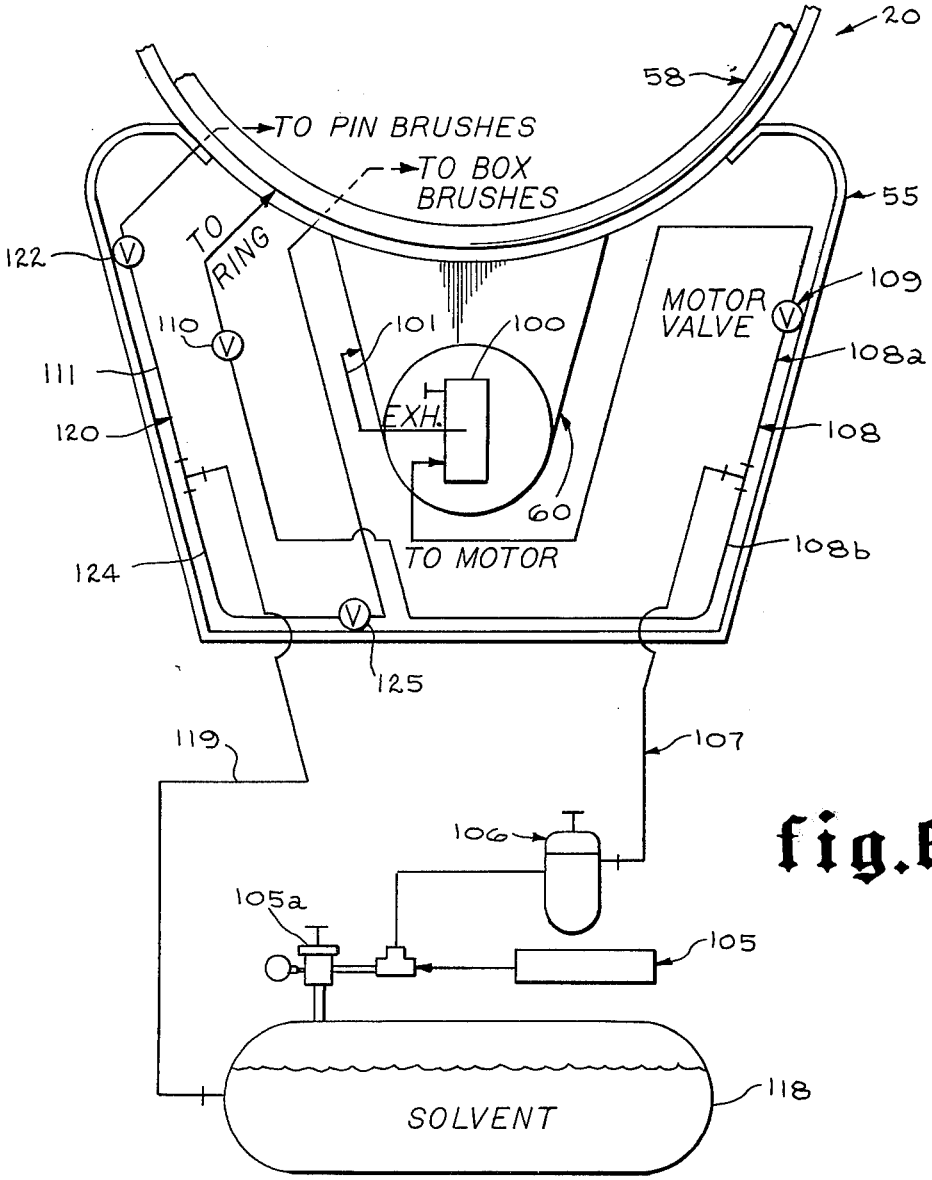
fig.6

CLEANER FOR TUBULAR PIN AND BOX ENDS

SUMMARY OF THE INVENTION

Where the ends of tubular members are to be connected together whether by threads or some other means, it may be desirable to clean the ends of the tubular members before connecting them together which may aid in assuring the integrity of the connection of the tubular member ends and inhibit leakage at the connection. Connection of tubular members is required in many instances such as by way of example only, flow lines, pipe lines, various conduits in industrial applications and tubular members which are used in connection with mineral exploration and production and oil, gas and water well casing and production strings.

In many instances at the present time, such devices are manually cleaned merely by a cloth or wire brush which may not be completely desirable in all circumstances. In other situations some types of power actuated cleaners are provided in an endeavor to clean the ends of tubular members before they are connected together.

It is sometimes more desirable to clean the ends of tubular members which are to be connected together immediately prior to their connection, and in some circumstances it may even be desirable to simultaneously clean opposed ends of tubular members prior to their joining together.

The present invention includes a housing means with the housing means having open ends for receiving the pin or male end of a tubular member in one open housing end and the box or female end of a tubular member in the other open housing end with brush means being rotatably mounted in the housing means and positioned relative to the open housing ends for engaging the respective pin and box ends on a tubular member and means for rotating the brush means to clean the engaged pin and box end of a tubular member.

Yet a further object of the present invention is to provide a cleaner for the pin or male and box or female ends of a tubular member including a housing means wherein the housing means includes a first portion having an open end for receiving the male or pin end of a tubular member and a second housing portion having an open end for receiving the female or box end of a tubular member. Support means connect the first and second housing portions to position their open ends in opposite facing directions and shaft means are rotatably carried by the support means and extend between the first and second housing portions with brush support means mounted on such shaft means in each of the housing portions whereby power means may be employed for rotating the shaft means to rotate the brush support means in the housing portion.

Yet a further object of the present invention is to provide a cleaner for the pin or male and box or female ends of a tubular member including a housing means wherein the housing means includes a first portion having an open end for receiving the threaded male end of a tubular member and a second housing portion having an open end for receiving the threaded female end of a tubular member. Support means connect the first and second housing portions to position their open ends in opposite facing directions and shaft means are rotatably carried by the support means and extend between the first and second housing portions with brush support means mounted on such shaft means in each of the housing portions whereby power means may be employed for rotating the shaft means to rotate the brush support means in the housing portion. Brush means are provided on the brush support means for engaging and cleaning the tubular member threaded ends when the power means rotate the shaft means.

Yet a further object of the present invention is to provide a cleaner for the pin or male and box or female ends of a tubular member including a housing means wherein the housing means includes a first portion having an open end for receiving the male end of a tubular member and a second housing portion having an open end for receiving the female end of a tubular member. Support means connect the first and second housing portions to position their open ends in opposite facing directions and shaft means are rotatably carried by the support means and extend between the first and second housing portions with brush support means mounted on such shaft means in each of the housing portions whereby power means may be employed for rotating the shaft means to rotate the brush support means in the housing portion. Brush means are provided on the brush support means for engaging in cleaning the tubular member ends when the power means rotate the shaft means. Means are also provided for conducting solvent to the housing means with valve means to control the flow of solvent to assist in cleaning the tubular member ends in the housing.

Yet a further object of the present invention is to provide a cleaner for the pin or male and box or female ends of a tubular member including a housing means wherein the housing means includes a first portion having an open end for receiving the male end of a tubular member and a second housing portion having an open end for receiving the female end of a tubular member. Support means connect the first and second housing portions to position their open ends in opposite facing directions and shaft means are rotatably carried by the support means and extend between the first and second housing portions with brush support means mounted on such shaft means in each of the housing portions whereby power means may be employed for rotating the shaft means to rotate the brush support means in the housing portion. Brush means are provided on the brush support means for engaging in cleaning the tubular member ends when the power means rotate the shaft means. Means are also provided for conducting solvent to the housing means with valve means to control the flow of solvent to assist in cleaning the tubular member ends in the housing, and means are provided in the housing for discharging air on the tubular member end positioned therein to further assist in cleaning the tubular member ends and assist in drying thereof prior to connection of the tubular member ends together.

Still a further object of the present invention is to provide a housing including two housing portions which are connected together and have open ends facing in an opposite direction. Support means connect the housing portions together and a rotatable shaft extends between the two housing portions and includes an arrangement for supporting brushes with power means for rotating the shaft means to rotate the brush means. Means are also provided to support the housing means to enable it to be manually manipulated, such means including a pivotal arrangement so that the housing may be pivoted relative to its support means for cleaning tubular member ends at any desired angular relationship relative to the horizontal or vertical.

Other objects and advantages of the present invention will become more readily apparent from a consideration of the following drawings and description.

BRIEF DESCRIPTION OF THE DRAWINGS

FIG. 6 is a diagrammatic representation illustrating the conduit and valving arrangement which may be employed in connection with the invention;

FIG. 8 is an alternate form of support arrangement to enable the housing means to be moved in an arc up to 360°;

DESCRIPTION OF THE PREFERRED EMBODIMENT

The present invention will be described in detail in connection with its structure and use with tubular members having a threaded male or pin end and a threaded box or female end which are to be threadedly connected together. However, it can be appreciated that the present invention may be employed in any type arrangement where tubular members are to be connected together such as by forceably telescoping a male and female end together, welding or other connections, and the description in relation to threaded tubular member ends is primarily for purposes of illustration.

Figure 1:
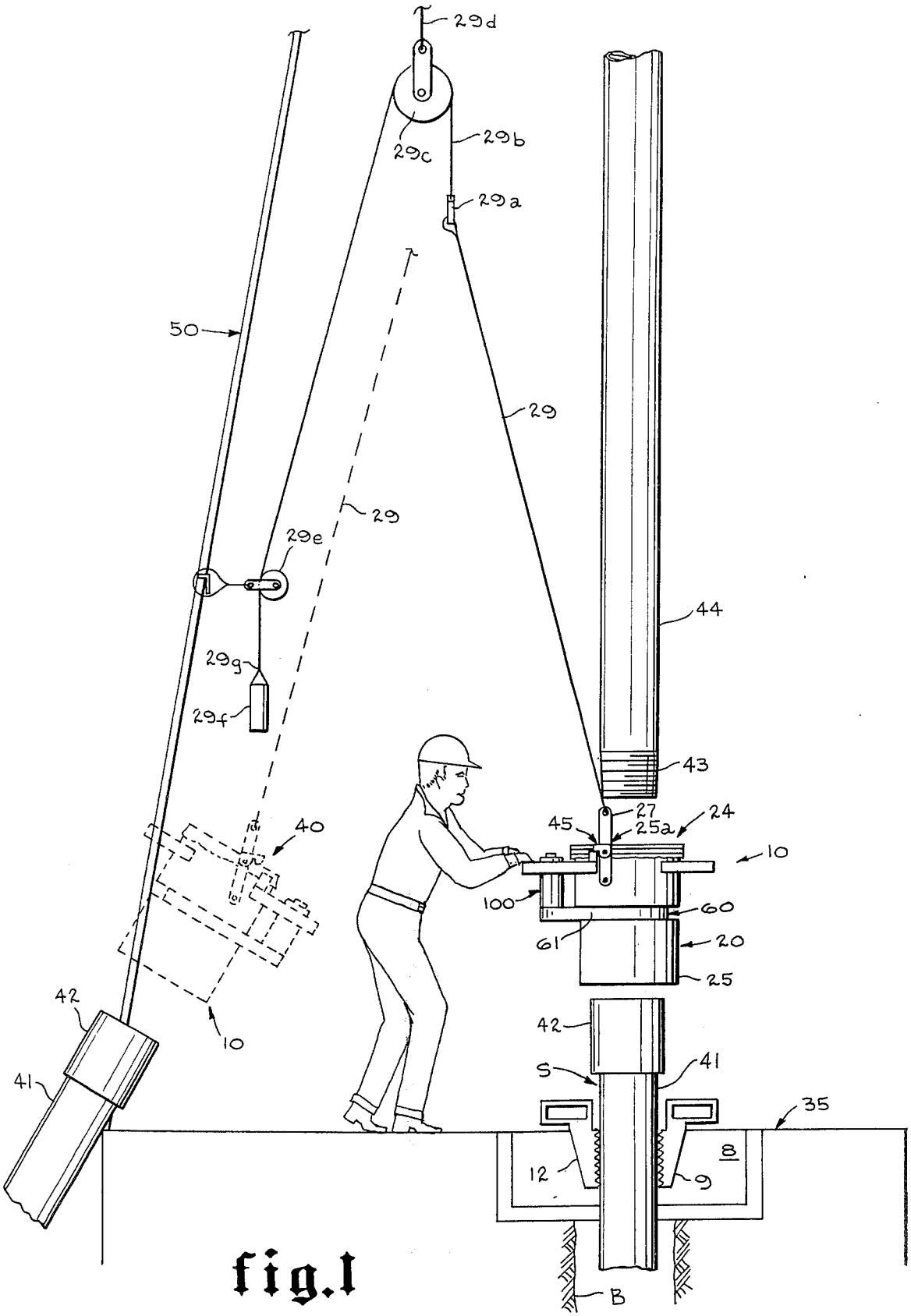
FIG. 1 is a diagrammatic sketch illustrating the cleaner of the present invention as it may be employed for connecting tubular members which are to be lowered into the earth, such as by way of example only in connection with oil, gas, water and other type of wells. In dotted line the invention as shown as being manuevered at an angular relation for cleaning a tubular member end in other than a vertical position.

Attention is first directed to FIG. 1 of the drawings wherein the present invention is referred to generally by the numeral 10 and is shown as including a housing means referred to generally by the numeral 20 which housing means includes a support arrangement referred to generally at 25*a* to enable the housing means 20 to be supported as generally illustrated at 30 relative to a working area represented at 35. It can be appreciated that where the present invention is to be employed in cleaning tubular members which are stacked or racked, the support arrangement 25*a* will be modified accordingly, and a different form of arrangement 30 may be employed.

The support arrangement 25*a* and arrangement 30 enable the housing means 20 to be positioned in any desired angular relationship relative to the working area 35 as may be desired as illustrated in dotted line at 40 and as will be described in greater detail hereinafter.

Tubular members are normally stacked adjacent a well location and come in various lengths from 20' to 40', depending upon the size tubular member. Each section or joint of tubular member is positioned adjacent the working area 35 and normally in an angular position such as represented by the tubular member 41 either adjacent the V-door ramp or in the mouse hole. The tubular member 41 is shown as being provided with a female or box end 42 which is shown as being in the form of a coupling, but in some instances it may be an integrally formed female arrangement on the tubular member. The tubular member also includes a male or pin end 43 which is not shown on tubular member 42, but which is illustrated on the tubular member 44. The tubular member 41, when moved from a pipe rack is generally positioned with the box end 42 up above the rig floor 35 as shown in FIG. 1 and with the pin end 43 disposed either in the mouse hole or at the bottom of the ramp. After the joints of tubular members have been moved from the position represented by tubular member 41 to the elevated position represented by tubular member 44, by suitable elevating mechanism well known in the art (not shown) and supported by the drilling mast or derrick referred to generally by the numeral 50 the box end 42 faces upwardly and the pin end 43 faces downwardly as shown. The construction and arrangement of the drilling mast or derrick will vary depending upon the type of operations being conducted and is well known to those skilled in the art.

In oil well drilling operations the working area 35 is the rig floor and it is normally provided with a rotary table 8 having a slip bowl 9 therein for receiving slips 12 for supporting the well string S in the well bore B. After a joint is connected into the well string S, the string S is elevated slightly and the slips 12 are removed in a manner well known in the art to enable such connected and well string joint to be lowered into the well bore B to position the last connected joint as represented by the tubular member 45 in FIG. 1.

Figure 2:
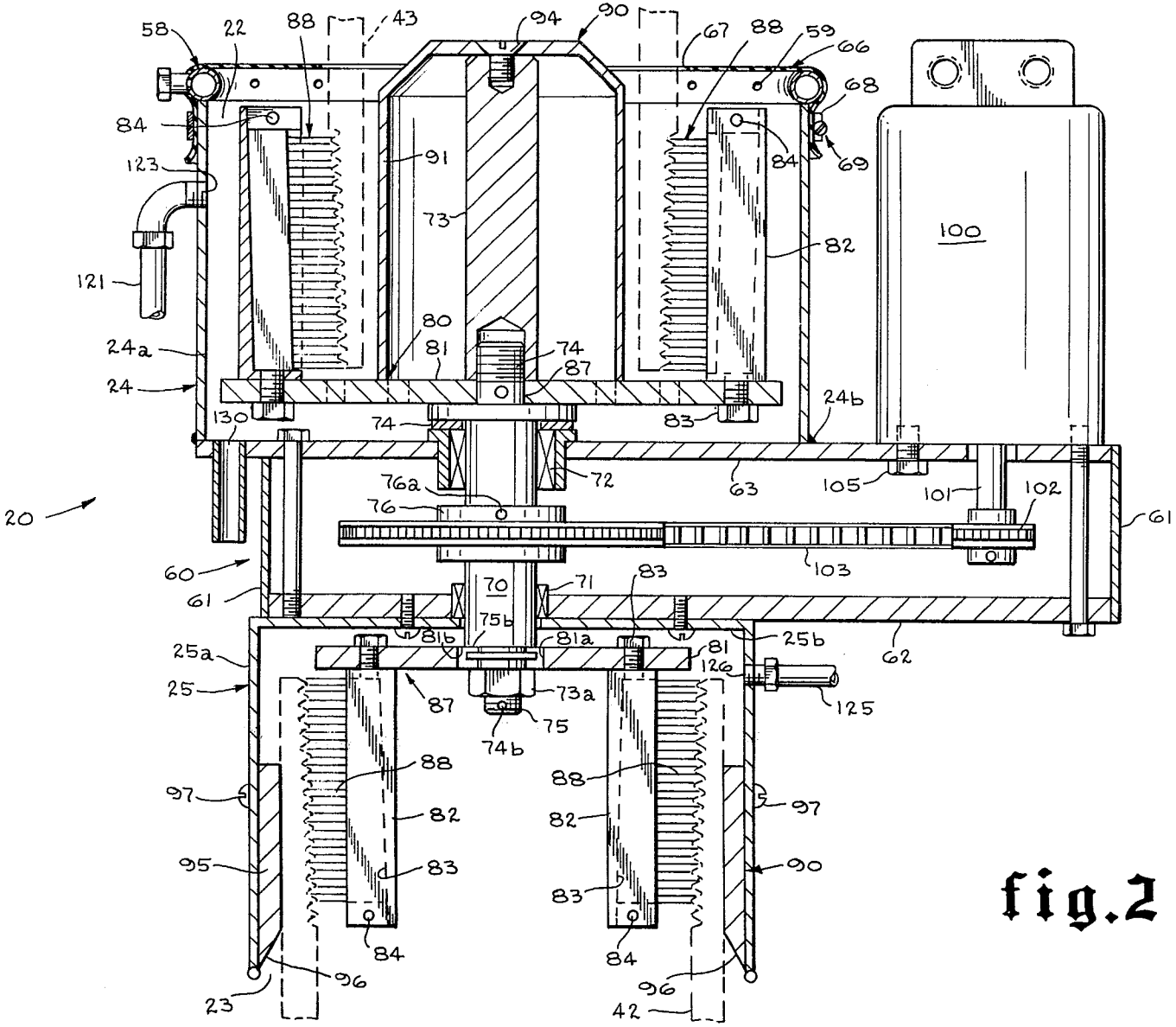
FIG. 2 is a vertical sectional view of the form of the invention illustrated in FIG. 1 showing the relationship of the first and second housing portion means, the support means connecting such housing portions together and an arrangement of the power source for supplying power to the rotatably mounted shaft means extending between the connected housing portions.

Attention is now directed to FIG. 2 wherein the housing means 20 is shown as being cylindrical in configuration; however such housing means 20 may be of any desired or suitable configuration.

Such housing means includes open ends 22 and 23 facing in opposite directions for receiving respectively the pin end 43 and box end 42 of tubular members for cleaning thereof as will be described.

The housing means 20 also includes a first housing portion referred to generally at 24 and a second housing portion referred to generally at 25. The first and second housing portions 24 and 25 are formed by the outer walls 24*a* and 25*a* respectively which extend circumferentially to provide the openings 22 and 23 of a desired size.

Support means referred to generally at 60 connect the first and second housing portions 24 and 25 together to position them in alignment and with their ends 22 and 23 facing in opposite directions. The support means 60 includes the vertical plate member 61 extending between the first and second housing portions 24 and 25 with the horizontal member or plate 62 extending generally at right angles to the plate member 61. An additional plate 63 may also form part of the support means 60 and as illustrated in the drawings the outer wall 24*a* is secured to the plate 63 by suitable means such as the weld 24*b*. The member 61 is secured to the plates 62 and 63 by suitable means such as welding or the like and the member 61 along with plates 62, 63 forms an outer covering for the drive mechanism of the invention as will be described. It is to be noted that the second housing portion 25 is shown as having a bottom 25*b* which is secured to or integrally formed with the wall 25*a* extending laterally therefrom and which abuts plate 62. It can be appreciated that the housing portion 24 could be provided with a similar bottom if so desired rather than employing the plate 63 of the support means 60 as the bottom surface of the first housing portion 24.

Shaft means 70 are rotatably carried by the support means 60 and extend between the first and second housing portions 24, 25 as shown in FIG. 2 of the drawings. Such shaft means 70 is rotatably supported in the support means 60 by any suitable means such as the bearings 71 and 72 between the plates 62 and 63 respectively. In addition a thrust bearing 74 may be provided as part of the bearing arrangement.

The shaft means 70 includes ends 74 and 75 which extend into the first and second aligned housing portions 24 and 25 respectively as illustrated and mounted on the ends 74 and 75 are brush support means 80 and 87 respectively.

Figure 7:
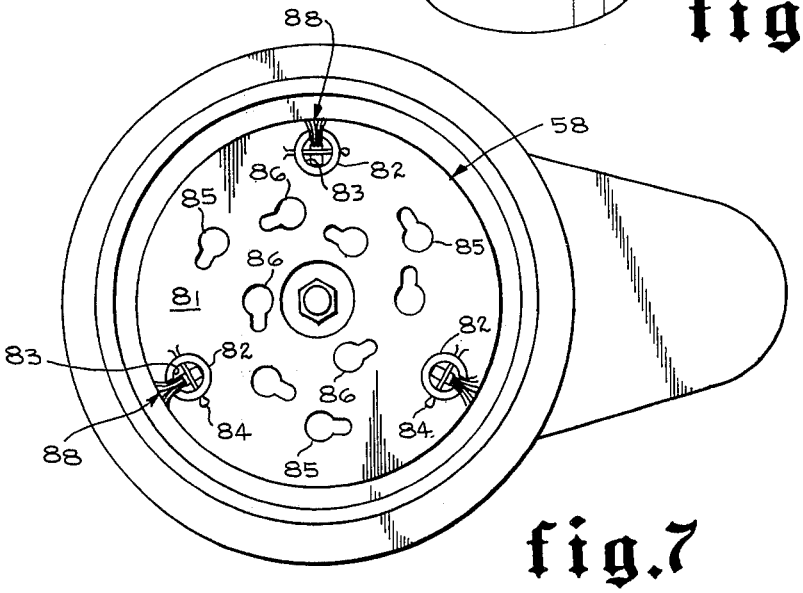
FIG. 7 is a partial top plan view illustrating an arrangement of the brush support means and brush means, and an arrangement for accommodating various diameter of tubular member ends for cleaning thereof.

The brush support means 80, 87 each include the plate or disc means 81 on which is mounted circumferentially spaced members 82 that extend generally longitudinally of the first and second housing portions 24, 25 as shown in FIGS. 2 and 7 of the drawings. Suitable means 83 are provided for removably securing the circumferentially spaced members to the disc or plate 81, in each housing portion and the members 82 include a longitudinally extending groove or opening 83 for receiving the brush means 88 therein. The brush means 88 may be removably secured in the members 82 by any suitable means such as the cotter key 84 or other arrangement to enable the brushes to be removed and replaced as they become worn. The discs 81 each includes a plurality of groups of holes or openings therein such as referred to at 85, 86 by way of illustration which, along with the group of openings in which the members 82 are shown as being positioned in FIG. 7 are spaced radially so that when the members 82 are positioned in the groups of openings shown, or in the groups 85 or 86, they will be positioned to accommodate the ends of tubular members of varying diameter.

The disc means 81 which is received in housing portion 24 includes a central opening 87 which fits over the end 74 of the shaft means 70. The shaft or member 73 may be then threadedly engaged with the threads on the end portion of the end 74 of shaft means 70 to secure the disc 81 in position in the first housing portion 24. The plate 81 may be retained in position on the end 75 of the shaft means 70 by suitable means such as the slot 81*a* in disc 81 which receives the pin 81*b* extending through shaft means 70. This secures the disc 81 and shaft means 70 for rotation together. Nut 73*a* which is threadedly engaged with the threaded portion of the end 75 of shaft means 70 abuts disc 81 against shoulder 75*b* on shaft means 70 to secure the disc on the shaft end 75. A locking pin 74*b* may be secured through the end of the shaft 75 to inhibit premature dislocation of the nut 73*a* and brush support arrangement 87 from the second housing portion 25.

Suitable guide means referred to at 90 are provided for the first and second housing portions. 24, 25. In the first housing portion 24, such guide means includes a longitudinally extending housing 91 which may be secured to the shaft or member 73 by any suitable means such as the screw 94, and such housing 91 is spaced radially relative to the brush support means 82 and brush means 88. The housing 91 thus rotates with the shaft means 70 and its connected disc 81 of the first housing portion 24 and is of suitable diameter to telescopically guide and receive the pin or male end 43 of a tubular member as illustrated in dotted line in FIG. 2 of the drawings.

The guide means 90 associated with the second housing portion 25 may be in the form of a plurality of circumferentially spaced longitudinally extending members 95 which are provided with a tapered surface 96 facing in the direction of the open end 23 of the second housing portion 25. Such longitudinally extending members 95 may be secured to the interior surface of the wall 25*a* by suitable means such as the screws 97.

The support means 60 may also serve as a support for a power source referred to generally at 100 which may be any suitable type motor such as air, electric or hydraulic. The motor 100 includes a drive shaft 101 on which is positioned a drive member or a gear 102. A driven gear or sprocket 76 is mounted on the shaft means 70 between the first and second housing portions 24, 25. The gear or sprocket 76 is secured to shaft means 70 by any suitable means such as the screw 76*a*. A suitable chain or belt 103 connects the drive member 102 with the driven member 76 whereby rotation may be imparted to the shaft means 70.

It will be noted that the support means 60 spaces the first and second housing means longitudinally relative to each other to accommodate the drive arrangement for the shaft means 70 as shown in the drawings. The power source may be connected to the support means 60 and supported thereon by any suitable means such as by the bolts 105.

Figure 4:
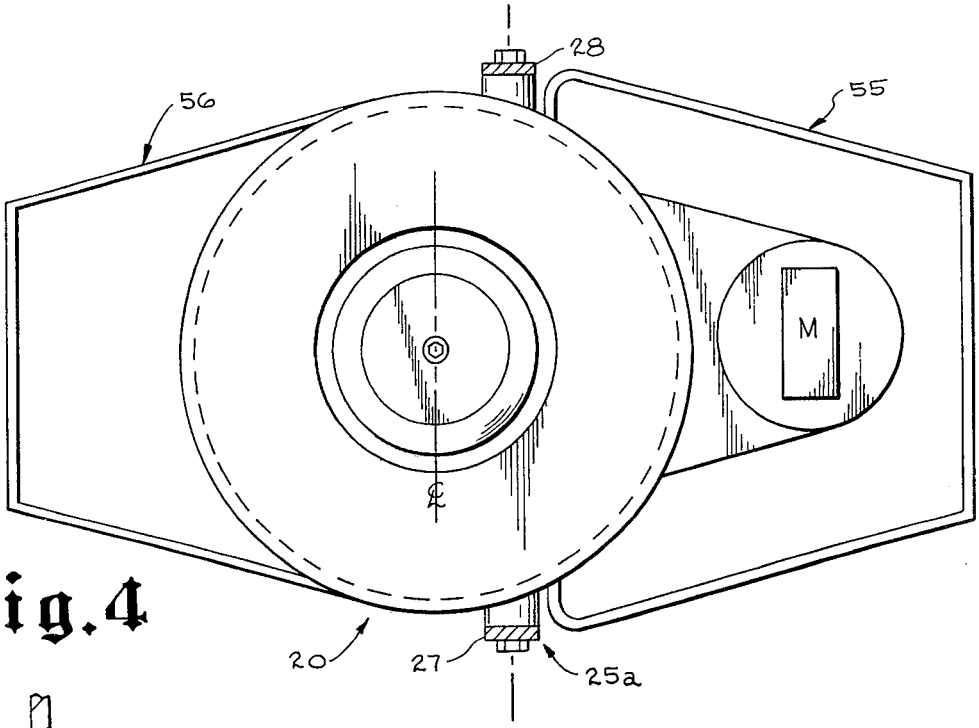
FIG. 4 is a top plan view illustrating an arrangement of the housing means, support means for enabling the housing means to be positioned relative to a work area and handle means for manipulating the housing means in use of the device.
Figure 3:
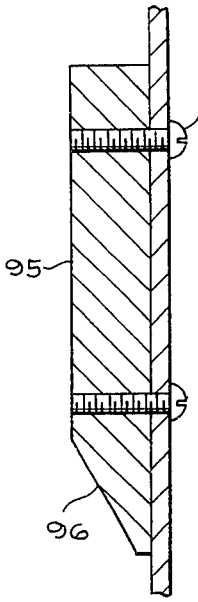
FIG. 3 is a partial sectional view illustrating an arrangement of a form of guide means.

Means are provided as referred to generally at 25*a* in FIGS. 1 and 4 for enabling the housing 20 to be supported in an elevated position relative to a working area when it is to be employed as illustrated in FIG. 1 of the drawings. In the form shown in FIG. 4 such support means 25*a* include the pair of members 27 and 28 pivotally secured to the housing means in any suitable manner and extending upwardly therefrom as shown in FIG. 1 of the drawings. When the present invention is to be employed as generally shown in FIG. 1 and as will be described in greater detail hereinafter, suitable flexible cables 29 may be connected with each of the members 27 and 28 at one end and to a bar 29*a* at their other end. An additional cable 29*b* is connected to bar 29*a* and extends over the pulley or sheave 29*c* which pulley or sheave is supported by any suitable arrangement such as the cable referred to at 29*d* in the derrick 50. The cable 29*b* extends from pulley 29*c* and through the pulley 29*e* with the counterweight 29*f* being connected thereto at the cable end 29*g* to assist in counterbalancing and manipulation of the invention 10 when it is moved from one position to another when used on a rig floor.

FIG. 8 shows an alternate support arrangement 25*b*. In this form members 27*a* and 28*a* are secured to and extend longitudinally of housing means 20. Members 27*b* and 28*b* are pivotally mounted in the ends of 27*a* and 28*a* as shown and extend laterally relative thereto. The ends of 27*b* and 28*b* are in the form of eye bolts 27*c* and 28*c* which are engaged with members 27*d* and 28*d* as shown in the drawings. Members 27*d* and 28*d* are pivotally connected with ends 27*c* and 28*c* and are in turn connected to cables 29 which are connected to bar 29*a* at their upper end. This arrangement enables the invention 10 to be swung in an arc up to 360° between the cables 29.

FIG. 4 also shows suitable handle means referred to generally at 55 and 56 to enable the housing means 20 to be manipulated for engagement with the pin and box ends of the tubular members to be cleaned.

Figure 5:
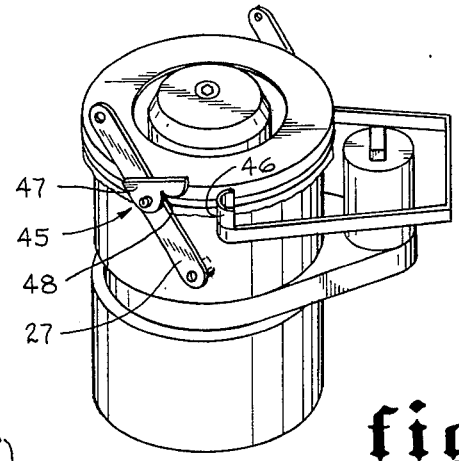
FIG. 5 is a detailed view of a form of latch means for securing the housing in relation to the support means.

FIG. 5 shows in greater detail the latch arrangement referred to generally at 45. Such latch arrangement includes an upstanding portion 46 positioned on the handle means and a pivotally mounted member 47 having an opening or notch 48 therein for engagement with the upstanding member 46. By manually disengaging the member 47 from the upstanding portion 46 on the handle means 55, housing means 20 may be then tilted relative to its support arrangement 25*a* and then lowered at an angle so that the second housing portion telescopically receives the box or female member 42 of the tubular member 41 represented in the position of FIG. 1 of the drawings or when positioned in a mouse hole. The operator then actuates the valve 109 and the valve 125 whereupon the brush means in the second housing portion engage with the threads on the box end 42 for cleaning thereof while solvent is simultaneously discharged into the second housing portion from the conduit 125 to further aid in cleaning.

Figure 9:
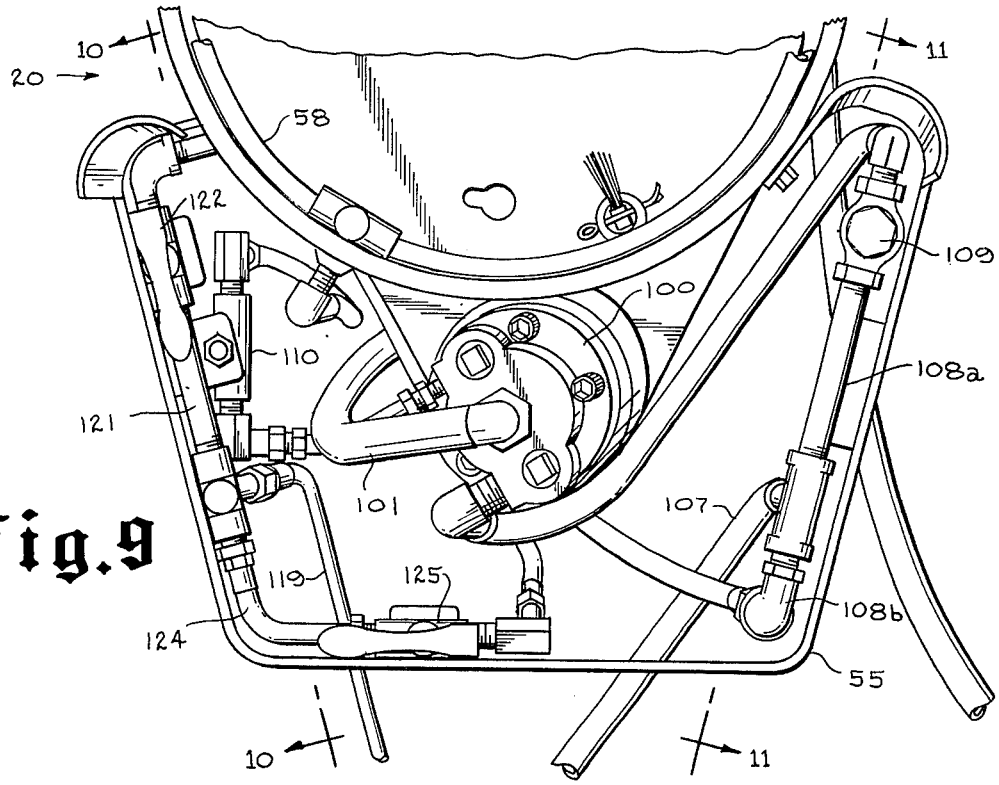
FIG. 9 is a top plan view of a portion of the handle means and controls associated therewith.
Figure 10:
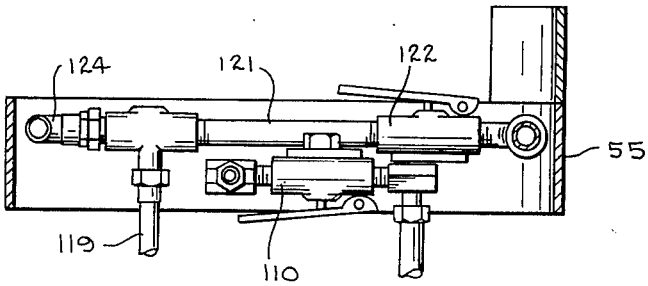
FIG. 10 is a view on the line 10—10 of FIG. 9.
Figure 11:
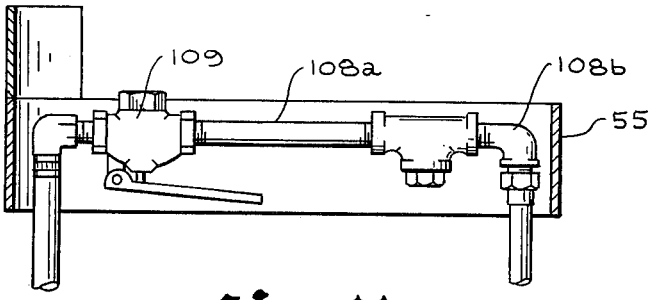
FIG. 11 is a view on the line 11—11 of FIG. 9.

In FIG. 6 a diagrammatic representation is shown of an arrangement for supplying fluid to operate the power means 100, for supplying solvent to the first and second housing portions 24 and 25 and for supplying air to the housing means 20. Assuming that the power source or power means 100 to be an air motor, a source of air supply under pressure is illustrated at 105 which is conducted through a lubricator illustrated at 106 and a conduit 107. The conduit 107 may be a flexible hose and it in turn is connected to a conduit 108, with a valve means 109 being positioned in the conduit portion 108*a* for controlling supply to the air power means 100. It can be appreciated that the valve means 109 may be of any suitable form such as a lever actuated type and may be positioned adjacent the handle means 55 for actuation thereof when the operators hand is manually engaged with the handle 55 as shown in FIGS. 9 and 11. The conduit portion 108*b* communicates through the valve 110 to the means represented generally at 58 for supplying air to the first housing portion circumferentially thereof. A valve 110 controls the low of air to ring 58, such valve being positioned adjacent handle means 55 for actuation as shown in FIGS. 9 and 10.

As shown in FIG. 2, the means 58 includes a hollow tubular member which extends circumferentially adjacent the open end 22 of the first housing portion and is provided with a plurality of circumferentially spaced openings or perforations 59 so that when the valve 110 is actuated air will be discharged into the first housing 24 portion and onto the pin or male end 43 of the tubular member as the first housing portion 24 and pin end 43 are moved relative to each other to disengage whereupon such air further aids in cleaning and drying the threads that have been engaged by the brush means.

In some circumstances it may be desirable to provide a solvent to further assist in cleaning of the pin end 43 and box end 42 of the tubular members to be engaged and cleaned by the present invention and to this end a solvent tank is provided as illustrated at 118 which may be pressurized from the air supply source 105 through the pressure regulator 105*a* . A conduit 119 conducts solvent to the conduit 120. A valve 122 is arranged adjacent handle means 55 as shown in FIGS. 9 and 10, and is connected in the conduit portion 121 which communicates solvent from the solvent supply 118 to the first housing portion 24 through the opening 123 provided therein as shown in FIG. 2 of the drawings. The conduit portion 124 supplies solvent through the valve means 125 to be discharged through the openings 126 in the second housing portion 25 as shown in FIG. 2 of the drawings. The valve 125 is also adjacent the handle means 55 for easy actuation and access as shown in FIG. 9.

When the air control valve 109 is actuated to open it and supply air from the air supply 105 to the air power means 100, the shaft means 70 is rotated and as previously noted and as illustrated in the drawings, the support means 60 by the arrangement of the plates 61, 62 and 63 encloses the drive arrangement for such shaft means 70. If desired the exhaust from the air motor may be conducted through the conduit 101 to be discharged into the housing arrangement formed by 61, 62 and 63 to aid in cooling of the drive arrangement.

The solvent discharged into the first housing means 24 may be conducted therefrom through the opening 130, and if desired a suitable conduit (not shown) may conduct such solvent back to the solvent supply 118.

It generally may be desirable to provide a cover for the first housing portion 24 such cover being formed of any suitable resilient material or elastomer material as represented at 66, and having a central opening 67 therethrough for receiving the pin or male end 43 illustrated in dotted line.

Suitable means such as the strap 68 and locking arrangement referred to at 69 may be employed for removably positioning to cover 66 in position on the first housing means.

In operation of the present invention, it may be employed simultaneously to clean the pin end 43 of a tubular member while cleaning the box end 42 of a tubular member, or it may be employed selectively as desired to separately clean the box and pin ends 42 and 43 respectively. Normally, such ends would be cleaned separately but this may not always be the condition.

As previously mentioned joints of tubular members are initially positioned relative to a rig floor as shown in FIG. 1 of the drawings and as represented by the tubular member 41. It may be positioned on the ramp adjacent the V-door of the drilling mast or rig, or it may be elevated and placed into what is commonly referred to as mouse hole which is a hole extending through the working floor 35 at an angle relative to and spaced from the well bore B.

An any event, the support arrangement enables the present invention 10 to be positioned over the box end 42 of tubular member 41 as shown in dotted line in FIG. 1 and cleaned by actuation of the motor 100, and solvent control valve 125, as previously described.

After the tubular member 41 has been cleaned, it is then engaged by elevating means well known in the art and elevated to the position represented by the tubular member 44 in the drilling mast or rig. At this time the pin end 43 is in an elevated position relative to the working floor 35 and positioned above and in spaced relationship to the tubular member 45 which forms the uppermost end of the well string S extending into the well bore B, as shown in FIG. 1. The operator then moves the invention 10 to the position shown in solid line in FIG. 1 of the drawings and elevates the invention 10 so that the pin end 43 of the generally vertically positioned tubular member 44 is telescopically received within the first housing means 24 to be engaged by the brushes 88 whereupon the valve means 109 is again actuated to rotate such brush means for cleaning of the threads on the pin end 43 of the tubular member 44. Simultaneously, solvent is discharged into the first housing portion 24 through the opening 123 when the valve 122 is actuated to further aid in cleaning the threads.

It can be appreciated that the guide 91 telescopically receives the pin end 43 of the tubular member as it is inserted into the first housing portion 24 to guide such pin member into position relative to the brush means 88.

When the brush means 88 has completed its operation, the invention 10 is lowered, and as it is lowered or the tubular member 44 raised, so as to withdraw the pin end 43 from the first housing portion 24, the valve 110 is actuated to supply air to the hollow circular conduit 58 to dry the threads on the pin end 43 of the tubular member.

This generally is the preferred manner of use of the present invention, however in some circumstances it may be that the apparatus is employed to simultaneously clean the pin end 43 and box end 42 of tubular members positioned therein, and the operation would be as described previously since actuation of the air motor 100 provides power for rotating the shaft means 70 to rotate both sets of brush means 88 in the first and second housing portions 24 and 25 respectively as described.

The present invention may be employed to clean pipe which is racked or stacked.

The foregoing disclosure and description of the invention are illustrative and explanatory thereof, and various changes in the size, shape, and materials as well as in the details of the illustrated construction may be made without departing from the spirit of the invention.

What is claimed is:

1. A cleaner for the threads on the pin and box ends of tubular members including:

a. housing means;

b. said housing means having open ends for receiving the pin end of a tubular member in one open housing end and the box end of a tubular member in the other open housing end;

c. brush means rotatably mounted in said housing means and positioned relative to said open housing ends for engaging the pin and box end threads on the tubular members; and d. means for rotating said brush means to clean the engaged pin and box end threads of the tubular members.

2. The invention of claim 1 including guide means supported by said housing means to aid in positioning the pin and box ends of the tubular members in the open housing ends.

3. The invention of claim 2 wherein said guide means includes:

a. first guide means which is secured adjacent the open housing end that receives the box end of a tubular member therein; and b. additional guide means rotatably mounted in said housing means for telescopically receiving the pin end of a tubular member.

4. A cleaner for the threads on the pin and box ends of tubular members including:

a. housing means;

b. said housing means including:

1. a first housing portion having an open end for receiving the pin end of a tubular member therein;

2. a second housing portion having an open end for receiving the box end of a tubular member therein;

c. support means connecting said first and second housing portions to position their open ends in opposite directions;

d. shaft means rotatably carried by said support means and extending between said first and second housing portions;

e. brush support means mounted on said shaft means in each of said housing portions and brush means on said support means;

f. power means for rotating said shaft means to rotate the brush support means in said housing portions;

g. means for conducting solvent to said first and second housing portions;

h. valve means to control the solvent flow to said first and second housing portions; and i. said first housing portion having means to discharge the solvent therefrom.

5. The invention of claim 4 including means carried by said first housing portion to discharge gas circumferentially on the pin end of a tubular member.

6. The invention of claim 5 wherein said guide means includes:

a. guide means mounted on said brush support means and rotatable therewith for telescopically receiving the pin end of a tubular member; and b. additional guide means mounted on said second housing portion for guiding the box end of a tubular member into said second housing portion.

7. The invention of claim 5 wherein said means carried by said first housing portion includes an annular ring having openings circumferentially spaced for discharging air into said first housing portion.

8. The invention of claim 4 including guide means in said first and second housing portions to aid in positioning the pin and box ends respectively of a tubular member therein.

9. A cleaner for the threads on the pin and box ends of tubular members including:

a. housing means;

b. said housing means including:

1. a first housing portion having an open end for receiving the pin end of a tubular member therein;

2. a second housing portion having an open end for receiving the box end of a tubular member therein;

c. support means connecting said first and second housing portions to position their open ends in opposite directions;
d. shaft means rotatably carried by said support means and extending between said first and second housing portions;
e. brush support means mounted on said shaft means in each of said housing portions;
f. power means for rotating said shaft means to rotate the brush support means in said housing portions;
g. brush means on said brush support means for engaging and cleaning the tubular member ends;
h. means for conducting solvent to said first and second housing portions;
i. valve means to control solvent flow to said first and second housing portions; and
j. said first housing portion having means to discharge the solvent therefrom.

10. The invention of claim 9 including guide means in said first and second housing portions to aid in positioning the pin and box ends respectively of a tubular member therein.

11. A cleaner for the threads on the pin and box ends of tubular members including:
a. housing means;
b. said housing means including:
1. a first housing portion having an open end for receiving the pin end of a tubular member therein;
2. a second housing portion having an open end for receiving the box end of a tubular member therein;
c. support means connecting said first and second housing portions to position their open ends in opposite directions;
d. shaft means rotatably carried by said support means and extending between said first and second housing portions;
e. brush support means mounted on said shaft means in each of said housing portions and brush means on said support means;
f. power means for rotating said shaft means to rotate the brush support means in said housing portions;
g. driven means mounted between said housing portions on said shaft means;
h. means for securing said power means to said support means connecting said first and second housing portions;
i. said power means having a drive shaft with drive means mounted thereon;
j. means connecting said drive and driven means for rotation of said shaft means by said power means;
k. means for conducting solvent to said first and second housing portions;
l. valve means to control the solvent flow to said first and second housing portions; and
m. said first housing portion having opening means to discharge the solvent therefrom.

12. The invention of claim 11 including guide means in said first and second housing portions to aid in positioning the pin and box ends respectively of a tubular member therein.

13. The invention of claim 11 including guide means in said first and second housing portions to aid in positioning the pin and box ends respectively of a tubular member therein.

14. A cleaner for the threads on the pin and box ends of tubular members including:
a. housing means;
b. said housing means including:
1. a first housing portion having an open end for receiving the pin end of a tubular member therein;
2. a second housing portion having an open end for receiving the box end of a tubular member therein;
c. support means connecting said first and second housing portions to position their open ends in opposite directions;
d. shaft means rotatably carried by said support means and extending between said first and second housing portions;
e. brush support means mounted on said shaft means in each of said housing portions;
f. power means for rotating said shaft means to rotate the brush support means in said housing portions; said brush support means including;
1. disc means mounted on said shaft means within said first and second housing portions;
2. circumferentially spaced members secured to said disc means and extending longitudinally of each said first and second housing portions; and
3. means for removably securing said members to said disc means; and
g. brush means in said circumferentially spaced members.

15. The invention of claim 14 wherein said disc means is provided with a plurality of groups of holes therein with each group being radially offset relative to adjacent groups for receiving said removable securing means to position said circumferentially spaced members at predetermined radial positions in said first and second housing portions.

16. The invention of claim 14 including:
a. means to removably secure said brush means in said circumferentially spaced member.

17. The invention of claim 14 including:
a. control means mounted adjacent said handle means for controlling the supply of power to said power means;
b. means for supplying solvent to said housing means; and
c. control means mounted adjacent said handle means for controlling the flow of solvent to said housing means.

18. The invention of claim 14 including:
a. means carried by said first housing portion to discharge gas circumferentially on the pin end of a tubular member; and
b. control means mounted adjacent said handle means for controlling the flow of gas to said first housing portion.

* * * * *